US009719479B2

(12) United States Patent
Ishii

(10) Patent No.: US 9,719,479 B2
(45) Date of Patent: Aug. 1, 2017

(54) IGNITION CONTROL DEVICE FOR INTERNAL COMBUSTION ENGINE

(71) Applicant: FUJI ELECTRIC CO., LTD., Kawasaki-shi (JP)

(72) Inventor: Kenichi Ishii, Matsumoto (CN)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 158 days.

(21) Appl. No.: 14/733,394

(22) Filed: Jun. 8, 2015

(65) Prior Publication Data

US 2016/0010615 A1 Jan. 14, 2016

(30) Foreign Application Priority Data

Jul. 11, 2014 (JP) ..... 2014-142971

(51) Int. Cl.
*F02P 3/045* (2006.01)
*F02P 3/04* (2006.01)
*F02P 15/08* (2006.01)

(52) U.S. Cl.
CPC ..... *F02P 3/0453* (2013.01); *F02P 3/0442* (2013.01); *F02P 15/08* (2013.01)

(58) Field of Classification Search
CPC ..... F02P 3/0453; F02P 3/0442; F02P 15/08
See application file for complete search history.

(56) References Cited

U.S. PATENT DOCUMENTS 4,377,138 A 3/1983 Mitani et al.
4,993,396 A 2/1991 Miura
5,634,453 A * 6/1997 Taruya ..... F02P 9/002 123/645
5,664,550 A * 9/1997 Ito ..... F02P 3/0552 123/630
5,970,964 A * 10/1999 Furuhata ..... F02P 3/0552 123/644

(Continued)

FOREIGN PATENT DOCUMENTS

CN 1229573 C 11/2005
CN 103527381 A 1/2014

(Continued)

OTHER PUBLICATIONS

European Search Report issued in counterpart application EP15171128, dated Dec. 14, 2015.

(Continued)

*Primary Examiner* — Hung Q Nguyen
*Assistant Examiner* — Xiao Mo
(74) *Attorney, Agent, or Firm* — Rossi, Kimms & McDowell LLP

(57) ABSTRACT

An ignition control device for an internal combustion engine can include an ignition coil supplying a discharge voltage to an ignition device of an ignition combustion engine, a voltage-controlled type semiconductor element connected to a primary side of the ignition coil and an ignition control section capable of repeating, multiple time in an ignition period, operations of turning ON and turning OFF of the voltage-controlled type semiconductor element by giving a gate signal to a gate of the voltage-controlled type semiconductor element. The ignition control section can include an active element that discharges gate charges accumulated on the gate of the voltage-controlled type semiconductor element upon turning OFF operation of the voltage-controlled type semiconductor element to the ground, and that is connected between the gate and a resistor at a side of the gate inserted in a gate wiring connected to the gate of the voltage-controlled type semiconductor element.

15 Claims, 10 Drawing Sheets

(56) References Cited

U.S. PATENT DOCUMENTS

| | | | | |
|---|---|---|---|---|
| 6,378,514 | B1 * | 4/2002 | Kaminaga | F02P 3/0552 123/633 |
| 6,595,194 | B1 | 7/2003 | Ito et al. | |
| 7,777,518 | B2 * | 8/2010 | Toyoda | H03K 17/06 123/644 |
| 9,447,767 | B2 | 9/2016 | Ishii | |
| 2004/0011342 | A1 * | 1/2004 | Fukatsu | F02P 3/0435 123/630 |
| 2004/0200463 | A1 * | 10/2004 | Ando | F02P 11/06 123/630 |
| 2014/0015005 | A1 * | 1/2014 | Ishii | F02P 11/00 257/139 |

FOREIGN PATENT DOCUMENTS

| | | | |
|---|---|---|---|
| EP | 0035407 | A2 | 9/1981 |
| EP | 2682593 | A2 | 1/2014 |
| GB | 1504731 | A | 3/1978 |
| JP | 07-103122 | A | 4/1995 |
| JP | 2000310173 | A | 11/2000 |
| JP | 2000-345949 | A | 12/2000 |
| JP | 3192074 | B2 | 7/2001 |
| JP | 3216972 | B2 | 10/2001 |

OTHER PUBLICATIONS

Office Action issued in Chinese Appln. No. 201510315539.0 mailed Nov. 28, 2016. English machine translation provided.

* cited by examiner

IGNITION CONTROL DEVICE FOR INTERNAL COMBUSTION ENGINE

CROSS-REFERENCE TO RELATED APPLICATION

This application is based on, and claims priority to, Japanese Patent Application No. 2014-142971, filed on Jul. 11, 2014, the contents of which are incorporated herein by reference, in their entirety.

BACKGROUND OF THE INVENTION

1. Field of the Invention

Embodiments of the invention relate to onboard ignition control devices for internal combustion engines.

2. Description of the Related Art

Ignition control devices for an internal combustion engine are known to conduct multiple ignition when spark performance is degraded because of decreased battery voltage, for example.

Japanese Unexamined Patent Application Publication No. H07-103122 (also referred to herein as "Patent Document 1") discloses an ignition control device for an internal combustion engine that conducts additional second and third ignition by repeating supplying and cutting of current at every 4 msec following an ignition at a normal ignition timing in the case of cold engine start or low water temperature.

Patent Document 1 discloses a conventional technology in which after a current supplying period of maintaining an ignition signal to command application of the battery voltage to the primary side of the ignition coil in an ON state, at least one time of combination of a discharge time and a rest time, the ignition signal being held in an OFF state in the discharge time and held in an ON state again in the rest time. Thus, multiple ignition is performed in which plural times of spark discharge occurs at a spark plug connected to the secondary side of the ignition coil, corresponding to the operating range.

In the conventional technologies disclosed in Patent Document 1 and Japanese Unexamined Patent Application Publication No. 2000-345949, the ignition device is ignited several times when the operation temperature is low or the battery voltage is low. These technologies employs a voltage-controlled type semiconductor element such as an insulated gage bipolar transistor and a power MOS field effect transistor for switching operation in the primary side of the ignition coil to control battery voltage application to the primary side of the ignition coil. The voltage-controlled type semiconductor element is ON/OFF-controlled receiving an ignition signal on the gate thereof, and when the voltage-controlled type semiconductor element transitions from an ON state to an OFF state, spark current is generated in the secondary side of the ignition coil to generate discharge at the ignition plug.

In order to produce several times of continuous spark ignition, the voltage-controlled type semiconductor element needs to repeat operations of turning OFF followed by turning ON. However, the response characteristic of the voltage-controlled type semiconductor element in the turning OFF operation may not be enough quick to follow the multiple ignition signal.

SUMMARY OF THE INVENTION

Embodiments of the invention address these and other problems in the art. Embodiments of the invention provide an ignition control device for an internal combustion engine that exhibits improved response characteristics in turning OFF operation of the voltage-controlled type semiconductor element.

Embodiments of the invention include: an ignition coil supplying a discharge voltage to an ignition device of an ignition combustion engine; a voltage-controlled type semiconductor element connected to a primary side of the ignition coil: and an ignition control section capable of repeating multiple times, in an ignition period, of operations of turning ON and turning OFF of the voltage-controlled type semiconductor element by giving a gate signal to a gate of the voltage-controlled type semiconductor element. The ignition control section includes an active element that discharges gate charges accumulated on the gate of the voltage-controlled type semiconductor element to the ground upon turning OFF operation of the voltage-controlled type semiconductor element. The active element is connected between the gate and a resistor at a side of the gate inserted in a gate wiring connected to the gate of the voltage-controlled type semiconductor element.

An embodiments of an ignition control device for an internal combustion engine is provided with an active element that discharges gate charges accumulated on the gate of the voltage-controlled type semiconductor element upon turning OFF operation of the voltage-controlled type semiconductor element to the ground, and the active element is connected on a gate wiring at close vicinity of the gate of the voltage-controlled type semiconductor element. As a result, the turning OFF operation of the voltage-controlled type semiconductor element is carried out with high speed response and follows the multiple ignition signal without delay. Therefore, multiple ignition of the ignition device is conducted without failure.

DETAILED DESCRIPTION

Figure 1:
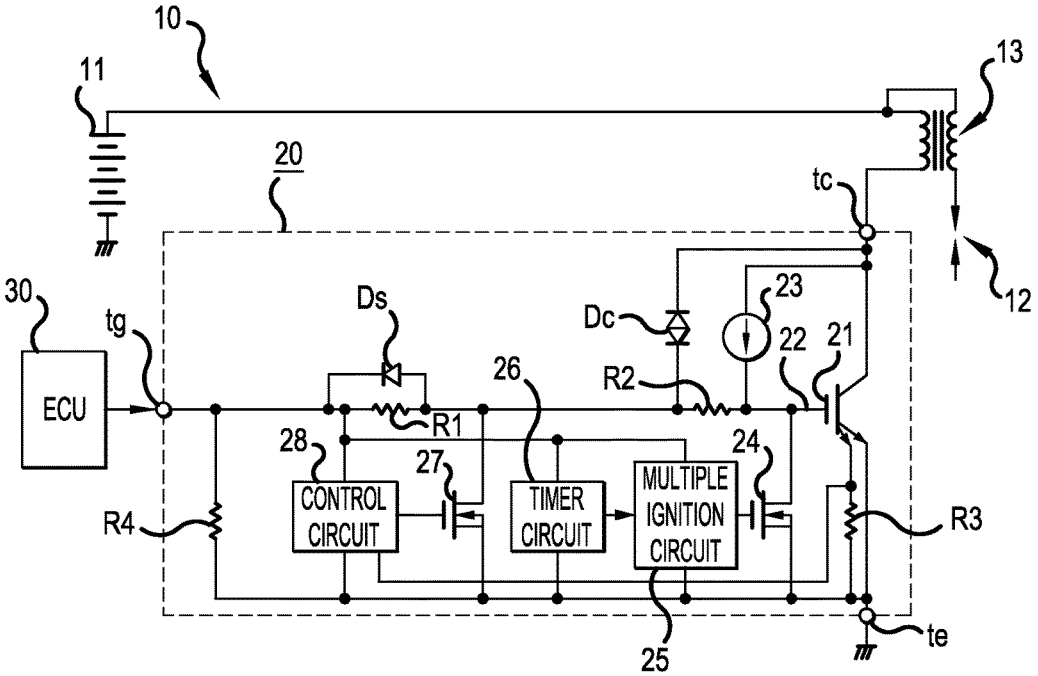
FIG. 1 is a circuit diagram of an ignition control device according to a first embodiment of the present invention.

The following describes in detail an ignition control device for an internal combustion engine according to a first embodiment of the present invention with reference to FIG. 1.

The ignition control device 10 as shown in FIG. 1 comprises an ignition coil 13 that is supplied with a power supply voltage from a battery 11 in the primary side and connected to an ignition device 12 in the secondary side. To the primary side of the ignition coil 13, an ignition control section 20 constructing a one-chip igniter is connected. An ignition signal is supplied to this ignition control section 20 from an engine control unit (ECU) 30.

The ignition control section 20 is provided with a collector terminal tc connected to an end of the primary winding of the ignition coil 13 at the opposite side of the battery 11, an emitter terminal te connected to the ground, and a gate terminal tg connected to the engine control unit 30.

Between the collector terminal tc and the emitter terminal te connected is a voltage-controlled type semiconductor element 21 composed of an insulated gate bipolar transistor (IGBT) or a power MOS field effect transistor, for example. The collector, which is a high potential side terminal, of the voltage-controlled type semiconductor element 21 is connected to the collector terminal tc, and the emitter, which is a low potential side terminal, of the voltage-controlled type semiconductor element 21 is connected to the emitter terminal te. The gate, which is a control terminal, of the voltage-controlled type semiconductor element 21 is connected through the gate wiring 22 to the gate terminal tg. At least two resistors R1 and R2 are inserted in the gate wiring 22 in series connection. The resistance value of the resistor R1 nearer to the gate terminal tg is larger than the resistance value of the resistor R2 nearer to the gate side of the voltage-controlled type semiconductor element 21. For example, the resistance value of the resistor R1 is about 5 kΩ, for example, and the resistance value of the resistor R2 is about 500Ω, for example.

A speed up diode Ds for fast turning OFF of the voltage-controlled type semiconductor element 21 is connected to the resistor R1 in parallel. The cathode of the speed up diode Ds is connected to the side of the gate terminal tg of the resistor R1, and the anode of the speed up diode Ds is connected to the side of the R1 in the side of the resistor R2.

Between the gate and the collector of the voltage-controlled type semiconductor element 21, a clamp diode Dc is connected between the collector electrode of the voltage-controlled type semiconductor element 21 and a point in the gate wiring between the resistors R1 and R2. An electric current flows through the clamp diode Dc when a voltage higher than a clamp voltage, for example 4000 V, is applied between the gate and collector of the voltage-controlled type semiconductor element 21. This current flows to the ground.

A high withstand voltage constant current circuit 23 is connected between the collector electrode and the gate electrode of the voltage-controlled type semiconductor element 21. The high withstand voltage constant current circuit 23 is composed of a depletion type insulated gate bipolar transistor, for example. The high withstand voltage constant current circuit 23 is inserted between a node between the collector electrode and the collector terminal tc and a node between the gate resistor R2 and the gate electrode of the voltage-controlled type semiconductor element 21. The high withstand voltage constant current circuit 23 relaxes abrupt rise up of the collector-gate current at the time of clamping of the clamp diode Dc.

A gate-emitter resistor R4 is inserted between a node on a portion of the gate wiring 22 between the resistor R1 and the gate terminal tg and the emitter terminal te.

A first active element 24 for pulling down is connected between a node on the gate wiring 22 between the resistor R2 disposed in the side of the gate of the voltage-controlled type semiconductor element 21 and the gate electrode of the voltage-controlled type semiconductor element 21, and the emitter terminal te. The first active element 24 is provided for fast response of a turning OFF operation of the voltage-controlled type semiconductor element 21 and composed of an n channel MOS field effect transistor, for example.

The first active element 24 is provided to discharge the charges accumulated on the gate of the voltage-controlled type semiconductor element 21 rapidly to the ground. The drain is connected to a point on the gate wiring 22 at the close vicinity of the gate of the voltage-controlled type semiconductor element 21, and the source is connected to the emitter terminal te. The connection of the drain of the active element 24 to the gate wiring 22 is the nearer to the gate electrode the more favorable. A resistance value of the gate wiring 22 between the connection point and the gate electrode is preferably smaller than 300 mΩ, more preferably smaller than 100 mΩ, most preferably less than 50 mΩ. Thus, the drain of the active element 24 is connected on the gate wiring 22 at the nearest point to the gate of the voltage-controlled type semiconductor element 21.

A gate signal is delivered to the gate of the first active element 24 from a multiple ignition circuit 25, which is a discharge control circuit. The multiple ignition circuit 25 operates with the gate signal received as power supply from the node between the resistor R1 and the cathode of the speed up diode Ds. The multiple ignition circuit 25 also receives an operation signal from a timer circuit 26 that operates similarly with the gate signal received as power supply from the node between the resistor R1 and the cathode of the speed up diode Ds.

Figure 2:
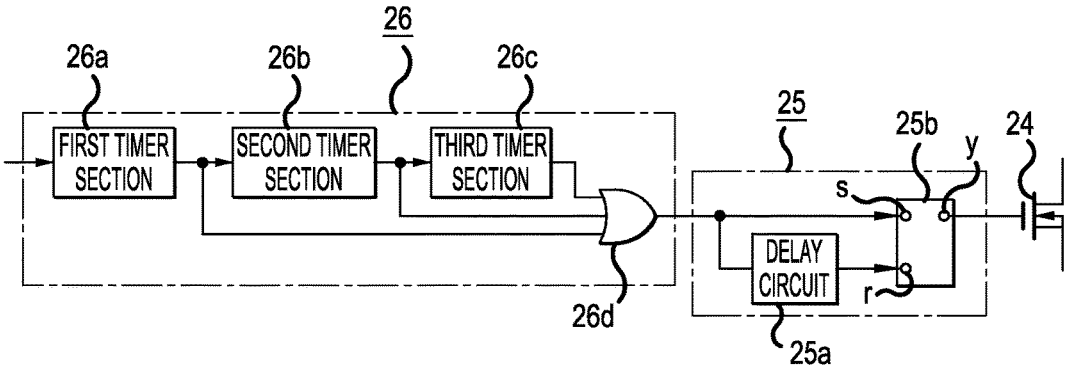
FIG. 2 is a circuit diagram of specific construction of a timer circuit and a multiple ignition circuit.

The specific construction of the multiple ignition circuit 25, as shown in FIG. 2, includes a flip-flop circuit 25*b* that receives an operation signal directly from the timer circuit 26 at a set terminal s and also through a delay circuit 25*a* at a reset terminal r. A gate signal is delivered to the first active element 24 from a positive output terminal y of the flip-flop circuit 25*b*.

The specific construction of the timer circuit 26, as shown in FIG. 2, includes a first timer section 26*a*, a second timer section 26*b*, and a third timer section 26*c* connected in series. The operation signals delivered from the three timer sections are given to the multiple ignition circuit 25 through an OR gate 26*d*.

The first timer section 26*a* starts operation at the time when the gate signal delivered by the engine control unit 30 rises up to a high level, and a time becomes up when a first timer period Tm1 has passed, the first timer period Tm1 being a time period from the start up to the time point that is predetermined time before the gate signal falls down to a low level. The first timer section 26*a* delivers a first operation signal with a pulse shape when the time is up.

The second timer section 26*b* starts operation receiving a first operation signal delivered by the first timer section 26*a*, and a time becomes up when a second timer period Tm2, which is shorter than the predetermined first timer period Tm1 of the first timer section 26*a*, has passed from the startup of the second timer section 26*b*. The second timer section 26*b* delivers a second operation signal when the time is up.

The third timer section 26*c* starts operation receiving a second operation signal delivered by the second timer section 26*b* and a time becomes up when a timer period that is equal to the second timer period Tm2 of the second timer section 26*b* has passed from the startup of the third timer section 26*c*. The third timer section 26*c* delivers a third operation signal when the time is up.

The first timer period Tm1 of the first timer section 26*a* is determined to be 80%, for example, of the ON period Ton of the gate signal delivered by the engine control unit 30. The second timer period Tm2 of the second timer section 26*b* and the third timer section 26*c* is determined to be 10%, for example, of the ON period Ton of the gate signal.

A second active element 27 for pulling down is connected between a node on the gate wiring 22 between the resistance R1 and the resistor R2, and the emitter terminal te. The second active element 27 receives a gate signal at the gate thereof from a control circuit 28.

The control circuit 28 is supplied with a gate voltage applied to the gate wiring 22 as a power source for the control circuit 28. The control circuit 28 performs overcurrent protection and overheat protection for the power-controlled type semiconductor element 21. The control circuit 28 receives the detection voltage at the current sensing terminal of the current detecting resistor R3 connected between the current sensing terminal of the voltage-controlled type semiconductor element 21 and the emitter terminal te. When the voltage-controlled type semiconductor element 21 has fallen into an overcurrent state, the control circuit 28 turns the second active element 27 ON to connect the gate wiring 22 to the ground. The gate voltage of the voltage-controlled type semiconductor element 21 is immediately lowered to turn OFF the voltage-controlled type semiconductor element 21. The control circuit 28, when the collector current Ic of the voltage-controlled type semiconductor element 21 has reached a current limiting value, controls the second active element 27 to maintain the current limiting value. The second active element 27 can be composed of plural active elements for overcurrent protection, for overheat protection, and for current limiting function.

The engine control unit 30 delivers a gate signal of a voltage signal at a high level in a predetermined ignition period at every time a predetermined ignition moment comes for igniting the ignition device.

Figure 3:
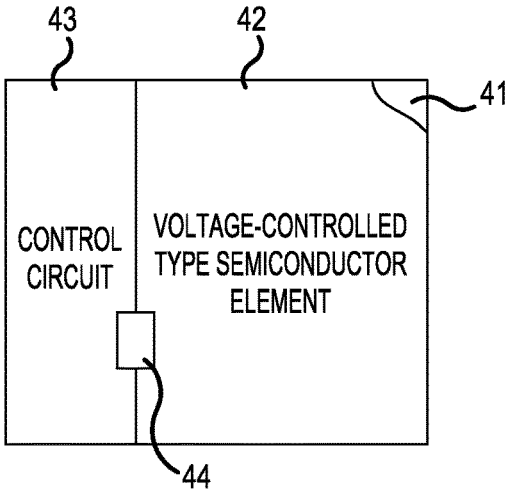
FIG. 3 is a plan view of an ignition control device formed in one chip.

FIG. 3 shows a construction of the ignition control section 20 that is composed of a one-chip igniter. As shown in FIG. 3 the ignition control section 20 is composed of a semiconductor element forming region 42 for forming the voltage-controlled type semiconductor element 21 and a control circuit forming region 43 for forming the control circuit 28, the both regions being provided on a semiconductor substrate 41 made of silicon, for example, and being disposed adjacent to each other.

Figure 4:
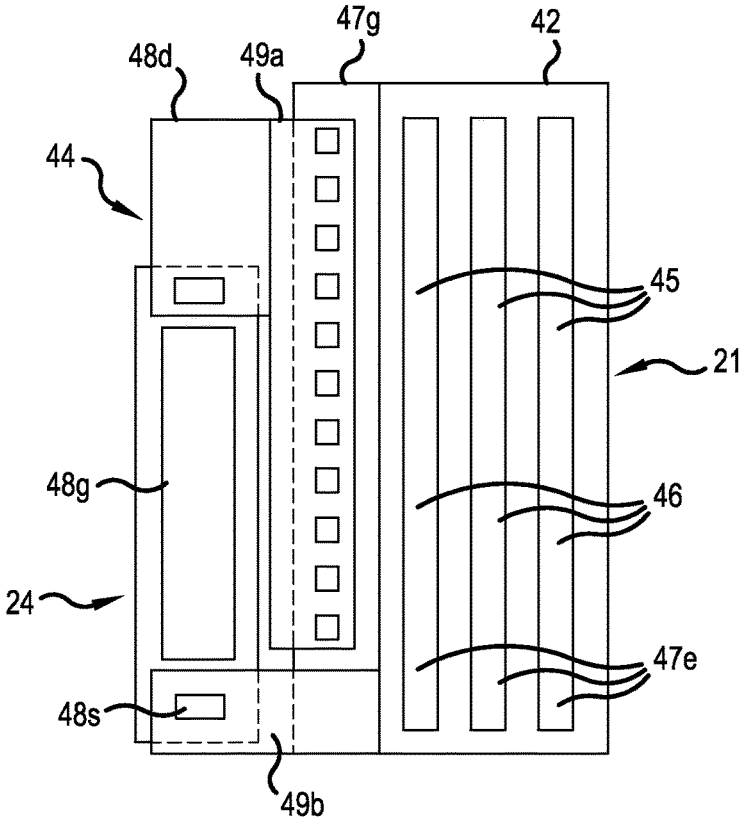
FIG. 4 is an enlarged view of an essential part of FIG. 3.

A first active element forming region 44 is provided at the boundary place between the semiconductor element forming region 42 and the control circuit forming region 43. FIG. 4 shows an enlarged view of the semiconductor element forming region 42 and the first active element forming region 44 in detail. The semiconductor element forming region 42 comprises, as shown in FIG. 4, a channel region 45, which is a well region, with a shape of stripes arranged on one principal surface of the semiconductor substrate 41, and an emitter region 46 with a shape of stripes arranged in the surface layer of the channel region 45. An IGBT emitter electrode 47*e* is formed on the surface of the emitter region 46, and an IGBT gate electrode 47*g* is formed in the side of the control circuit forming region 43, as compared with the emitter electrode 47*e*.

The first active element 24 is formed in the first active element forming region 44 paralleled to the IGBT gate electrode 47*g*. On the surface of the first active element 24, a MOS drain electrode 48*d* and a MOS source electrode 48*s* are formed interposing a MOS gate electrode 48*g*.

The MOS drain electrode 48*d* is electrically connected to the IGBT gate electrode 47*g* through an electrode wiring section 49*a* with a narrower width than the MOS drain electrode 48*d*. The MOS source electrode 48*s* is electrically connected to the IGBT emitter electrode 47*e* through an electrode wiring section 49*b*.

Because the first active element forming region 44 is formed adjacent to the semiconductor element forming region 42 on the semiconductor substrate 41, the drain of the first active element 24 is disposed in close vicinity of the gate 47*g* of the voltage-controlled type semiconductor element 21. The drain 48*d* of the first active element 24 is connected to the gate wiring 22 at such a position that a resistance value of the gate wiring 22 to the gate 47*g* of the voltage-controlled type semiconductor element 21 is preferably less than 300 mΩ, more preferably less than 100 mΩ, most preferably less than 50 mΩ.

Now, operation of the ignition control devise according to the first embodiment example will be described with reference to FIG. 5.

Figure 5:
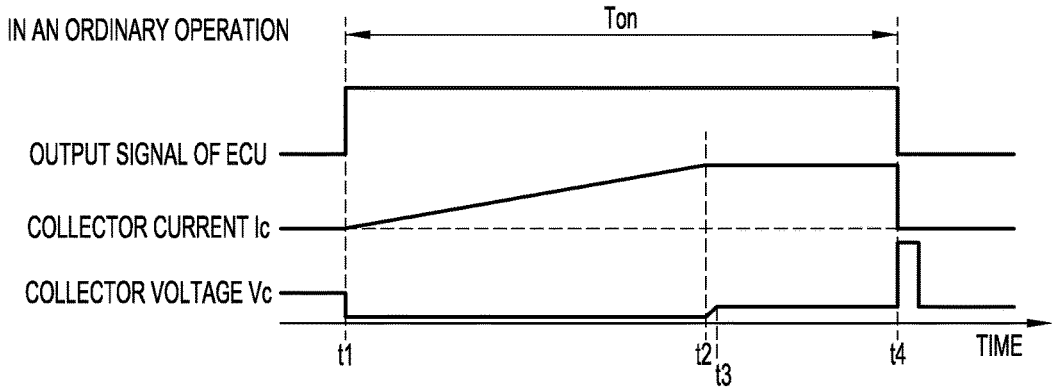
FIG. 5 is a time chart in normal operation to illustrate the operation of the first embodiment.

In an ordinary state in which the multiple ignition circuit 25 and the timer circuit 26 do not operate, a gate signal of a voltage signal at a high level during a predetermined, relatively long period as shown by the time chart (a) in FIG. 5 is delivered at a predetermined ignition time of the ignition device from the engine control unit 30 to the gate terminal tg of the ignition control section 20.

At the time t1 when the gate signal rises up from a low level to a high level, the voltage-controlled type semiconductor element 21 turns into an ON state and the collector current Ic of the voltage-controlled type semiconductor element 21 begins to increase as shown by the time chart (b) in FIG. 5. At the same time, the collector voltage Vc of the voltage-controlled type semiconductor element 21 drops to a low level, for example 1.3 V, near the ground level as shown by the time chart (c) in FIG. 5. Then at the time t2 when the collector current Ic of the voltage-controlled type semiconductor element 21 reaches a current limiting value, the collector voltage Vc slowly rises according to the voltage L (di/dt) where L is an inductance of the ignition coil 13 and di/dt is a current variation rate through the ignition coil 13. Then after the time t3, the collector voltage settles to a relatively low voltage for example 3 to 5 volts, and keeps at the constant voltage.

During the voltage-controlled type semiconductor element 21 is controlled in an ON state, electromagnetic energy is stored in the primary winding of the ignition coil 13. Then at the time t4 when the predetermined ignition period Ton is over and the gate signal returns to the low level, as shown by the time chart (a) in FIG. 5, the gate voltage of the voltage-controlled type semiconductor element 21 decreases through the speed up diode Ds to turn OFF the voltage-controlled type semiconductor element 21. At this time, the electromagnetic energy stored in the ignition coil 13 is transferred to the secondary winding and an induced voltage develops across the secondary winding corresponding to the current variation through the primary winding Thus, spark discharge takes place in the ignition device 12 to drive the internal combustion engine.

Figure 6:
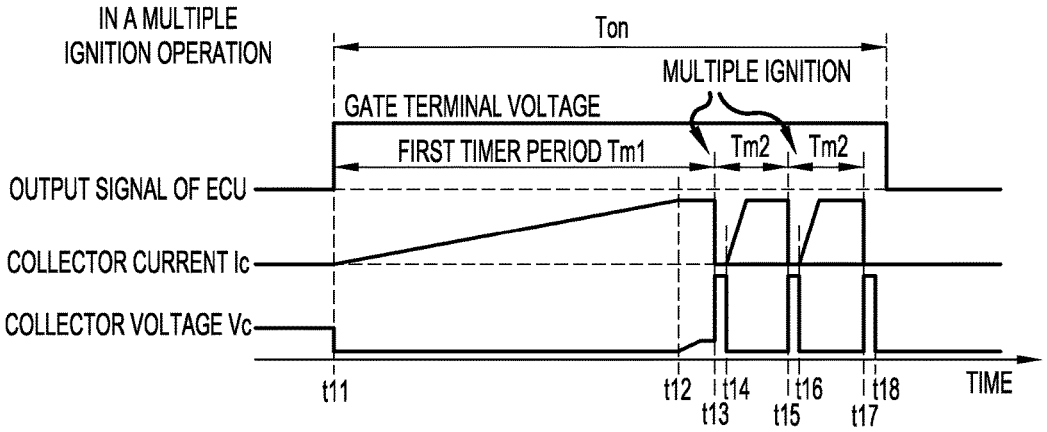
FIG. 6 is a time chart in multiple ignition operation to illustrate the operation of the first embodiment.

Different from the process described above when the multiple ignition circuit 25 and the timer circuit 26 are operated, a multiple ignition operation takes place as shown in FIG. 6.

The procedure from the time t11 to the time t12 is similar to the procedure from the time t1 to the time t2 shown in FIG. 5, wherein at the time t11, the gate signal delivered from the engine control unit 30 changes from a low level to a high level, and at the time t12, the collector current Ic through the voltage-controlled type semiconductor element 21 reaches the current limiting value. The procedure in FIG. 6 is different from the procedure in FIG. 5 during the period from the time t11 to the time t12 only in that the first timer section 26*a* of the timer circuit 26 begins operation at the time t11.

After the time t12, when the time becomes up for the first timer section 26*a* at the time 13 and a first operation signal is delivered, the second timer section 26*b* begins operation and at the same time the first operation signal is given as a trigger signal to the multiple ignition circuit 25 through the OR gate 26*d*. As a result, the flip-flop circuit 25*b* is set and a gate signal at a high level is delivered from the positive output terminal y to the gate of the first active element 24.

Accordingly, the first active element 24 turns ON and discharges the charges accumulated on the gate of the voltage-controlled type semiconductor element 21 to the ground abruptly without passing through any resistor element. As a result, the voltage-controlled type semiconductor element 21 turns OFF and the collector current Ic thereof is interrupted and decreased to zero at the time t13 as shown by the time chart (b) in FIG. 6. At the same time, the collector voltage Vc of the voltage-controlled type semiconductor element 21 rises abruptly to the clamp voltage of 400 V, for example, at the time t13 as shown by the time chart (c) of FIG. 6. Thus, spark discharge develops in the ignition device 12 to drive the internal combustion engine similarly to the process at the time t4 indicated in FIG. 5.

The multiple ignition circuit 25 and the timer circuit 26 are supplied with the gate signal as an operating power for the circuits from a node between the resistor R1 having a relatively large resistance value and the gate terminal tg. Consequently, even though the first active element 24 turns ON, the condition of power supply to the circuits is maintained and thus the multiple ignition circuit 25 and the timer circuit 26 continue to operate.

Then, at the time t14 when a delayed signal of the first operation signal is delivered from the delay circuit 25*a* of the multiple ignition circuit 25, the flip-flop circuit 25*b* is reset and changes the gate signal delivered from the positive output terminal y into a low level to turn the first active element 24 into an OFF state.

Accordingly, the state is resumed where the gate signal is supplied to the voltage-controlled type semiconductor element 21 through the resistor R1 on the gate wiring 22 to turn ON the voltage-controlled type semiconductor element 21. The collector current Ic increases rapidly and the collector voltage Vc decreases abruptly. Thus, electromagnetic energy is stored in the primary winding of the ignition coil 13.

After that at the time t15 when the second timer period Tm2 has passed and the time of the second timer section 26*b* becomes up, a second operation signal is delivered to the multiple ignition circuit 25 through the OR gate 26*d*. As a result, similarly to the process at the time t13 described above, the flip-flop circuit 25*b* in the multiple ignition circuit 25 is set and a gate signal at a high level is delivered from the positive output terminal y to the gate of the first active element 24. Accordingly, the first active element 24 is controlled into an ON state and the charges stored on the gate of the voltage-controlled type semiconductor element 21 are abruptly discharged to the ground through the first active element 24 without passing through any resistance element.

Consequently, the voltage-controlled type semiconductor element 21 turns OFF. The collector current Ic decreases abruptly and the collector voltage Vc abruptly rises up to the clamp voltage. Thus, similarly to the process at the time t13, a spark discharge takes place in the ignition device 12 to drive the ignition combustion engine.

After that, at the time t16 when a delay signal of the second operation signal is delivered from the delay circuit 25*a* of the multiple ignition circuit 25 to the reset terminal r of the flip-flop circuit 25*b*, the flip-flop circuit 25*b* is reset. The first active element 24 resumes an OFF state and the voltage-controlled type semiconductor element 21 returns to an ON state.

After that at the time t17 when the time of the third timer section 26*c* becomes up and a third operation signal is delivered, through the operation similar to the one at the time t15 described above, the first active element 24 turns ON and the voltage-controlled type semiconductor element 21 turns OFF abruptly to generate spark discharge in the ignition device 12. After that, at the time t18, similarly to the process at the time t16, the first active element 24 turns OFF and the voltage-controlled type semiconductor element 21 resumes the ON state. However, immediately after this event, the gate signal given from the engine control unit 30 reverses from the high level to a low level. As a result, the charges stored on the gate of the voltage-controlled type semiconductor element 21 are discharged through the resistor R2 and the speed up diode Ds toward the side of the engine control unit 30. Thus, the voltage-controlled type semiconductor element 21 turns OFF.

The ignition control device according to this embodiment example also comprises a clamp diode Dc and a high withstand voltage constant current circuit 23 connected in parallel between the collector and the gate of the voltage-controlled type semiconductor element 21. When the voltage-controlled type semiconductor element 21 turns OFF from the ON state and the collector voltage Vc of the voltage-controlled type semiconductor element 21 abruptly rises, and the collector voltage Vc reaches a predetermined voltage value for the clamp diode Dc for example 400 V, the collector voltage Vc is limited to the voltage value 400 V by flow of superfluous current through the clamp diode Dc and further through the speed up diode Ds and the resistor R4 between the gate and emitter, and through the emitter terminal te to the ground.

Figure 7:
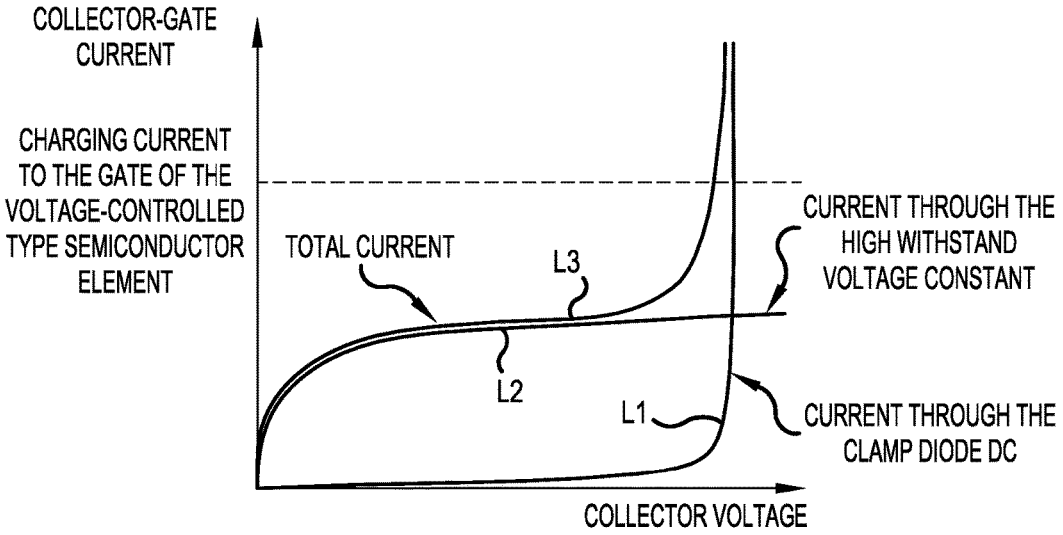
FIG. 7 is a characteristic diagram showing relationship between the collector voltage and the collector-gate current.

In this process, if only the clamp diode Dc is inserted between the collector and the gate, the collector-gate current rapidly rises, as shown by the characteristic cure L1 in FIG. 7, immediately before the collector voltage Vc reaches the predetermined voltage value. Thus, current variation rate of the collector-gate current increases resulting in instability of the clamp voltage.

The ignition control device according to the first embodiment example, however, comprises high withstand voltage constant current circuit 23 is provided connected in parallel to the clamp diode Dc. When the collector voltage Vc increases from a value near zero volts, the high withstand voltage constant current circuit 23 increases the collector-gate current in a saturation curve as shown by the characteristic curve L2 in FIG. 7. After that, the current settles to an approximately constant current value sufficiently small as compared with the gate charging current for the voltage-controlled type semiconductor element 21 irrespective of increase in the collector voltage.

Because the collector-gate current is the sum of the current flowing through the high withstand voltage constant current circuit 23 and the current flowing through the clamp diode Dc, the variation rate of the collector-gate current in the process the collector voltage Vc rises up to the clamp voltage is mild as shown by the characteristic curve L3 in FIG. 7. Therefore, the clamp voltage is prevented from unstable variation.

When the voltage-controlled type semiconductor element 21 has become an overcurrent state, the control circuit 28 detects the overcurrent and turn OFF the second active element 27 to turn ON the voltage-controlled type semiconductor element 21 and stop operation thereof. Likewise, when the temperature of the voltage-controlled type semiconductor element 21 rises and overheating state arises, the control circuit 28 turns the second active element 27 ON to stop driving of the voltage-controlled type semiconductor element 21.

In multiple ignition process of the ignition device 12 on continued several times by ON-OFF-driving the voltage-controlled type semiconductor element 21 in the ignition control device of the first embodiment, the multiple ignition circuit 25 connects the drain of the first active element 24 to the gate of the voltage-controlled type semiconductor element 21 at a position to attain a low wiring resistance without passing any resistance element, and the source of the first active element 24 is connected to the ground. Consequently, the turning OFF operation of the voltage-controlled type semiconductor element 21 is conducted with quick response in multiple ignition operation and good follow-up performance of the voltage-controlled type semiconductor element 21 is ensured in the multiple ignition process, thereby performing the multiple ignition operation without failure.

The multiple ignition operation in an ignition control device according to the first embodiment is conducted by operating the multiple ignition circuit 25 and the timer circuit 26 using the gate signal delivered by the engine control unit 30 as a power supply. Because it is not needed to provide an internal power supply circuit separately, the overall construction of the ignition control section 20 is simplified.

In addition, a high withstand voltage constant current circuit 23 is provided in parallel with the clamp diode Dc between the collector and gate of the voltage-controlled type semiconductor element 21. Consequently, rapid change in the collector-gate current is avoided and the variation of the collector voltage is smoothed.

Next, a second embodiment of the present invention will be described in the following with reference to FIG. 8.

In the second embodiment, the multiple ignition circuit 25 and the timer circuit 26 are operated in a low temperature environment. In the description of the second embodiment, the same members as in the first embodiment are given the same symbols and description therefor is omitted.

Figure 8:
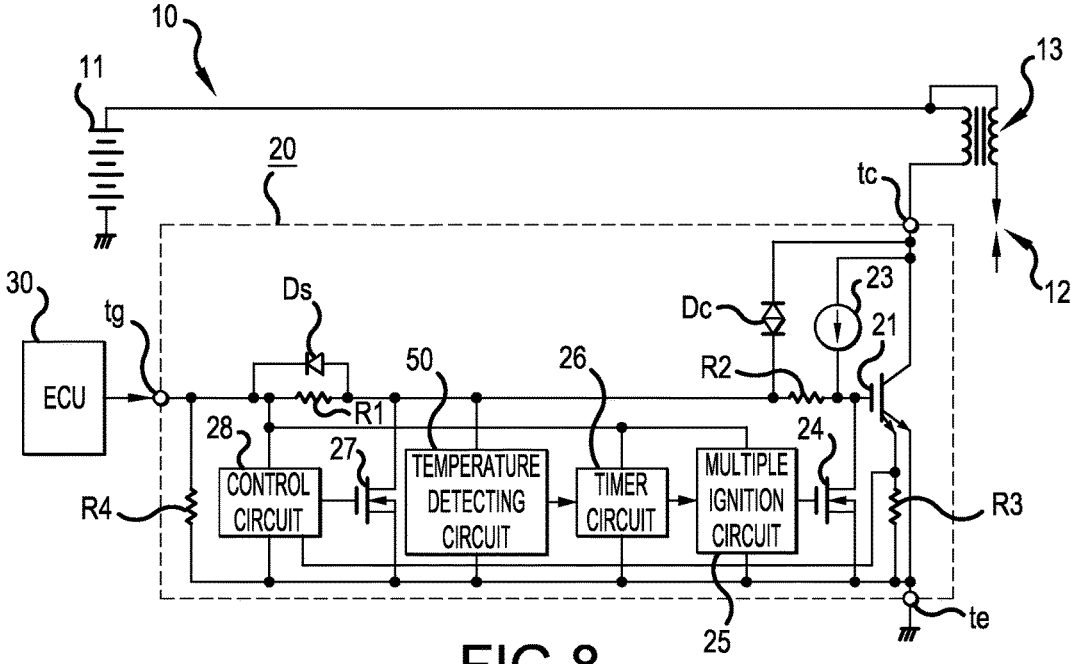
FIG. 8 is a circuit diagram of an ignition control device according to a second embodiment of the present invention.
Figure 9:
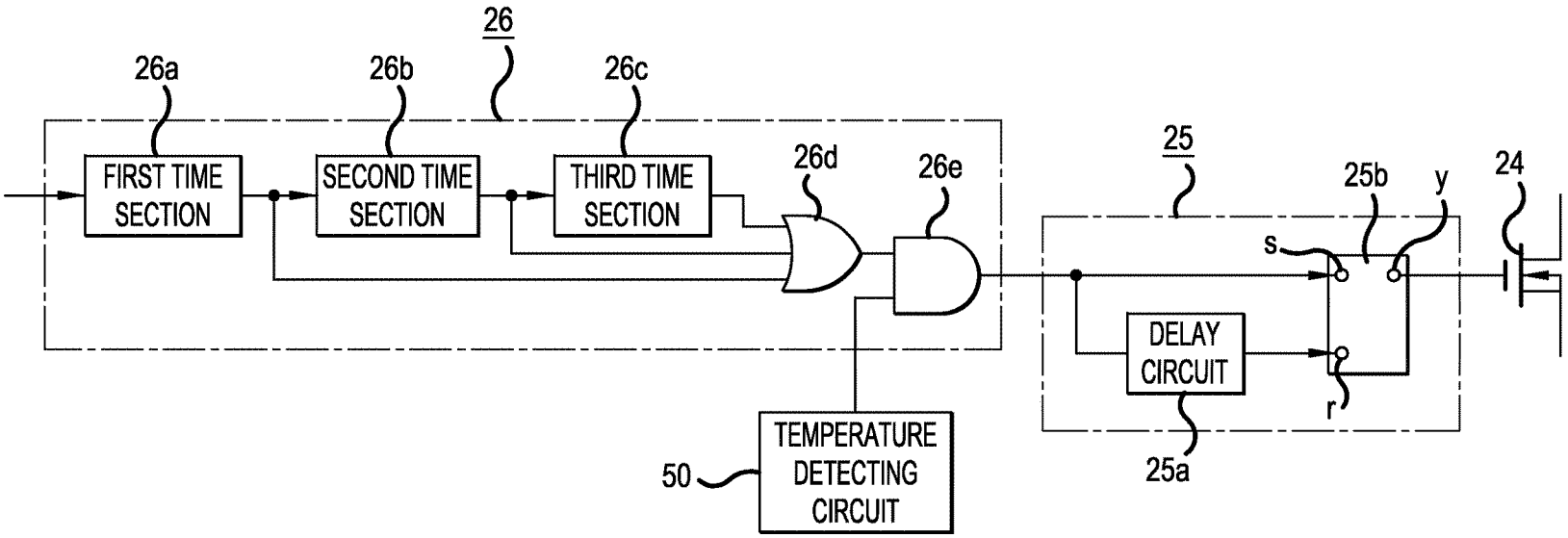
FIG. 9 is a circuit diagram of specific construction of a timer circuit and a multiple ignition circuit in the second embodiment.

As shown in FIG. 8, the ignition control device 10 of the second embodiment is provided with a temperature detecting circuit 50 in the ignition control section 20. The temperature detecting circuit 50 delivers a temperature detection signal to the timer circuit 26; the temperature detection signal turns to a high level under a low temperature condition in which the ignition device 12 hardly performs ignition operation in a cold district or other low temperature environments. As shown in FIG. 9, the output side of the OR gate 26*d* in the timer circuit 26 is connected to one input terminal of the AND gate 26*e*, and the other input terminal of the AND gate 26*e* receives the temperature detection signal delivered from the temperature detecting circuit 50.

Figure 10:
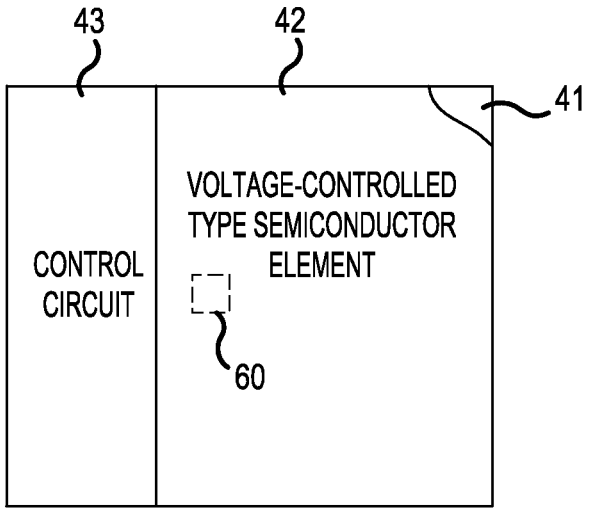
FIG. 10 is a plan view of an ignition control device formed in one chip in the second embodiment.
Figure 11:
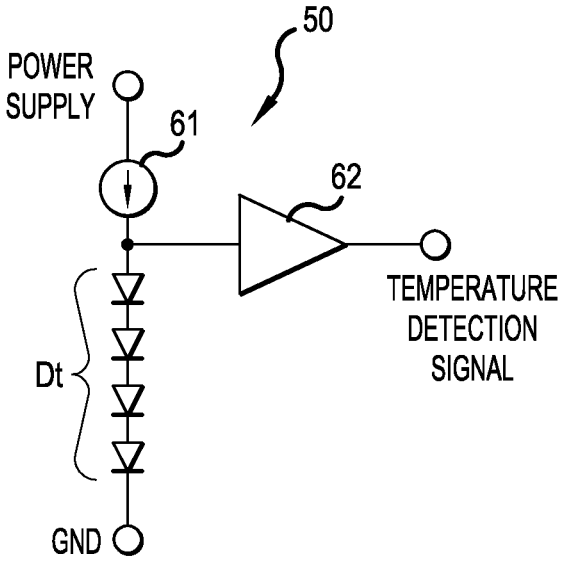
FIG. 11 is a circuit diagram of specific construction of the temperature detecting circuit.

The output of the AND gate 26*e* is delivered to the timer circuit 25 as an operating signal. The temperature detecting circuit 50 is formed in a temperature detecting region 60 that is provided in the semiconductor element forming region 42 on the semiconductor substrate 41 as shown in FIG. 10. The specific construction of the temperature detecting circuit 50 is composed of series-connected several stages, four stages for example, of temperature detecting diodes Dt formed in the temperature detecting region 60 as shown in FIG. 11. The anode of the temperature detecting diodes Dt is connected through a constant current circuit 61 to the connection point between the resistor R1 on the gate wiring 22 and the cathode of the speed up diode Ds, and the cathode of the temperature detecting diodes Dt is connected to the emitter terminal te as shown in FIG. 8 and FIG. 11.

A detected voltage at the connection point between the temperature detecting diode Dt and the constant current circuit 61 is delivered to a decision circuit 62. If the detected voltage is lower than the predetermined voltage value corresponding to the predetermined low temperature, the decision circuit 62 delivers a temperature detection signal St at a high level to the timer circuit 26.

In this second embodiment, when the temperature of the semiconductor element forming region 42 forming the voltage-controlled type semiconductor element 21 on the semiconductor substrate 41 is higher than the predetermined low temperature, the detected temperature at the connection point between the constant current circuit 61 and the temperature detecting diode Dt in the temperature detecting circuit 50 is higher than the predetermined voltage. As a result, the decision circuit 62 delivers a temperature detection signal St at a low level to the timer circuit 26.

The AND gate 26*e* of the timer circuit 26 is closed and does not deliver any operation signal. Consequently, the flip-flop circuit 25*b* of the multiple ignition circuit 25 keeps the reset state and the first active element 24 is held in an OFF state.

Thus, the voltage-controlled type semiconductor element 21 turns OFF when the gate signal delivered by the engine control unit 30 turns OFF from the ON state, and the normal ignition operation is performed as the operation of the first embodiment shown in FIG. 5.

When the vehicle is parking or running in a cold district and the temperature of the semiconductor element forming region 42 on the semiconductor substrate 41 is low, however, the detected voltage of the connection point between the constant current circuit 61 and the temperature detecting diode Dt decreases due to a small resistance value of the temperature detecting diode Dt and becomes lower than the predetermined voltage for low temperature setting. Consequently, the decision circuit 62 delivers a temperature detecting signal St at a high level to the timer circuit 26.

As a consequence, the AND gate 26*e* of the timer circuit 26 opens and the timer circuit 26 is possible to deliver an operation signal to the multiple ignition circuit 25.

When the gate signal given by the engine control unit 30 becomes a high level, the first operation signal, the second operation signal and the third operation signal are delivered from the timer circuit 26 through the OR gate 26*d* and the AND gate 26*e* to the flip-flop circuit 25*b* and the delay circuit 25*a* of the multiple ignition circuit 25. As a result, the multiple ignition circuit 25 starts a multiple ignition operation similar to the multiple ignition operation in the first embodiment and performs an operation similar to the one shown in FIG. 6. The flip-flop circuit 25*b* is set every time the first operation signal, the second operation signal, or the third operation signal is given and the gate signal is delivered to the first active element 24. As a result, the voltage-controlled type semiconductor element 21 turns OFF abruptly and the collector voltage rises up to the clamp voltage due to the clamp diode Dc. Thus, a multiple ignition operation is performed which repeats spark discharge three times in the ignition device 12.

An ignition control device according to this second embodiment conducts a multiple ignition operation only in a cold environment in which the voltage-controlled type semiconductor element 21 hardly triggers an ignition operation. In other environment, normal ignition operation is performed. In addition to the similar effects to the first embodiment, the second embodiment limits the number of spark discharge in the ignition device 12 as compared to the case to perform multiple ignition operation every time, which lead to a long life of the ignition device 12.

Figure 12:
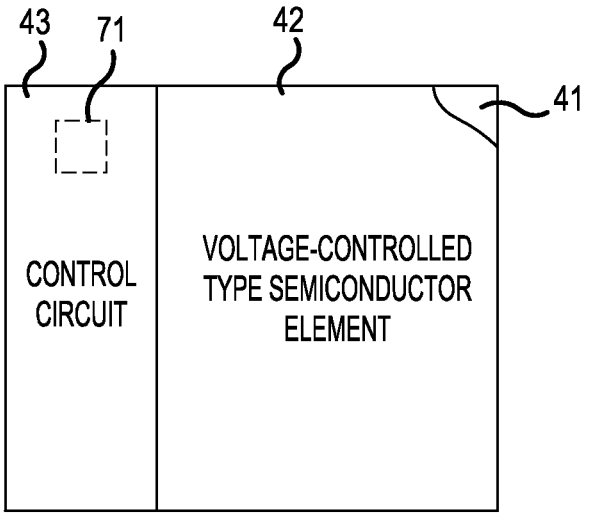
FIG. 12 is a plan view of an ignition control device formed in one chip in a variation of the second embodiment.
Figure 13:
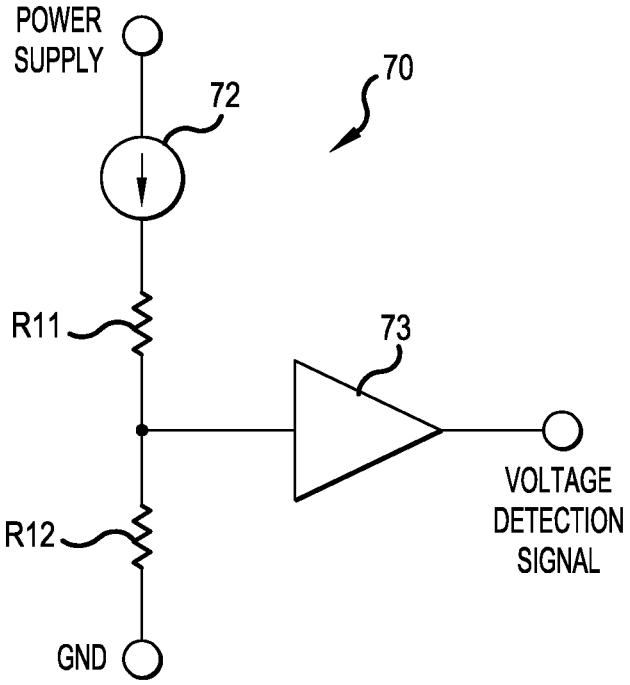
FIG. 13 is a circuit diagram of specific construction of the voltage detecting circuit and the multiple ignition circuit.

In the second embodiment described above, the multiple ignition operation is conducted only when the detected temperature of the voltage-controlled type semiconductor element 21 is low. However, a multiple ignition operation can be conducted in other cases. For example, a multiple ignition operation can be conducted when a drop of the battery voltage is detected. In this case as shown in FIG. 12, a voltage detection region 71 is formed in the control circuit forming region 43 on the semiconductor substrate 41, and a voltage detection circuit 70 having a circuit construction of FIG. 13 is formed in the voltage detection region 71. The voltage detection circuit 70 is composed of a series circuit of a constant current circuit 72 and a series circuit of shunt resistors R11 and R12, and formed between the emitter electrode, which is formed in the semiconductor element forming region 42, and the collector electrode, which is formed on the surface opposite to the emitter electrode. The detection voltage obtained at the connection point between the shunt resistor R11 and the shunt resistor R12 is delivered to a decision circuit 73. The decision circuit 73 determines whether the collector voltage or the battery voltage of the battery 11, has decreased below a predetermined voltage value. If the battery voltage is lower than the predetermined voltage value, the decision circuit 73 delivers a voltage detection signal at a high level to the AND gate 26*e* in the timer circuit 26 shown in FIG. 9.

In this construction, when the power supply voltage of the battery 11 is higher than the predetermined voltage value, a voltage detection signal at a low level is delivered from the decision circuit 73 of the voltage detection circuit 70 to the AND gate 26*e* of the timer circuit 26. As a result, the timer circuit 26 and the multiple ignition circuit 25 stop operation. However, when the power supply voltage of the battery 11 decreases and the collector voltage of the voltage-controlled type semiconductor element 21 becomes lower than the predetermined voltage value, a voltage detection signal at a high level is delivered from the decision circuit 73 of the voltage detection circuit 70 to the AND gate 26*e* of the timer circuit 26. As a result, the timer circuit 26 and the multiple ignition circuit 25 are made active to perform a multiple ignition operation.

Now, a third embodiment of the present invention will be described with reference to FIG. 14. In this third embodiment, a power of battery 11 is supplied to the ignition control section 20 to form an internal power supply 80 that drives the internal circuits of the ignition control section 20.

Figure 14:
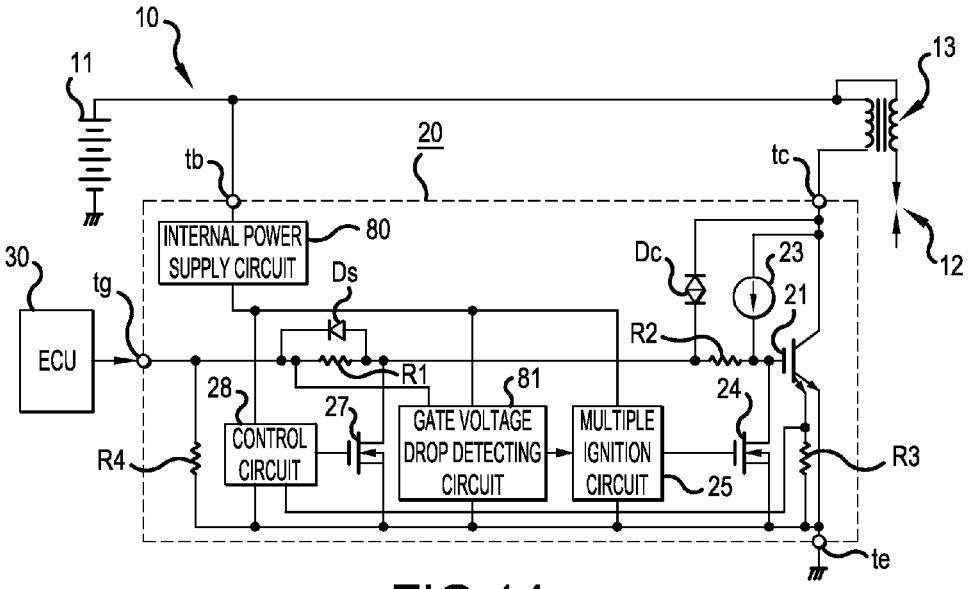
FIG. 14 is a circuit diagram of an ignition control device according to a third embodiment of the present invention.

In the third embodiment as shown in FIG. 14, the ignition control section 20 has a battery power input terminal tb that receives the battery power from the battery 11 and is provided with the internal power supply circuit 80 connected to the battery power input terminal tb in the ignition control section 20.

The ignition control section 20 includes, in place of the timer circuit 26, a gate voltage drop detecting circuit 81 that detects voltage drop at the time of inversion of the gate voltage from a high level to a low level.

The internal power supply circuit 80 is composed of a regulator that transforms the supplied battery voltage into an internal power supply voltage for operating the multiple ignition circuit 25, the control circuit 28, and the gate voltage drop detecting circuit 81, and delivers the internal power supply voltage to the multiple ignition circuit 25, the control circuit 28, and the gate voltage drop detecting circuit 81.

Because the multiple ignition circuit 25 and the gate voltage drop detecting circuit 81 in this construction do not receive power supply from the gate signal, the circuits can operate irrespective of the level of the gate signal.

Figure 15:
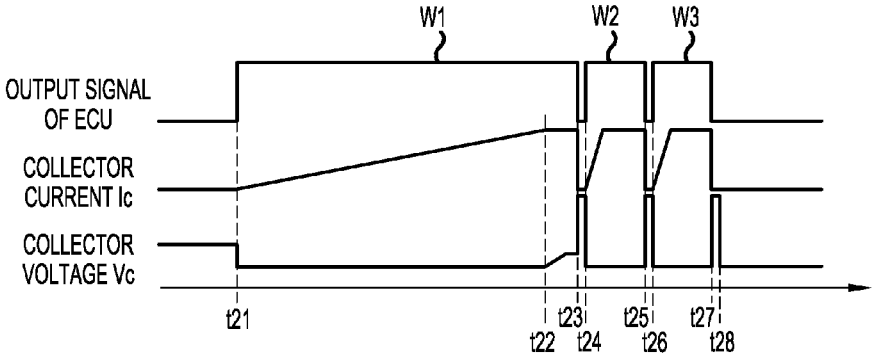
FIG. 15 is a time chart to illustrate the operation of the third embodiment.

In this third embodiment, the gate signal delivered by the engine control unit 30 has a multiple ignition scheme as shown in FIG. 15, making the multiple ignition operation enable as in the first and second embodiments. This gate signal is, different from the one in the first and second embodiments, a gate signal for multiple ignition. The gate signal for multiple ignition is composed of three rectangular waves: a first rectangular wave W1, a second rectangular wave W2, and a third rectangular wave W3 as shown in FIG. 15. The first rectangular wave W1 is a relatively long time period of a high level corresponding to the first timer period Tm1. The second rectangular wave W2 turns to a high level after passing a short period corresponding to the delay time of the delay circuit 25*a* after the first rectangular wave W1 has reversed into a low level, and holds the high level for a time period of the second timer period Tm2 subtracted by the delay time. The third rectangular wave W3 turns to a high level after passing a short period corresponding to the delay time of the delay circuit 25*a* after the second rectangular wave W2 has reversed into a low level, and holds the high level for a time period equal to the one in the second rectangular wave W2.

Figure 16:
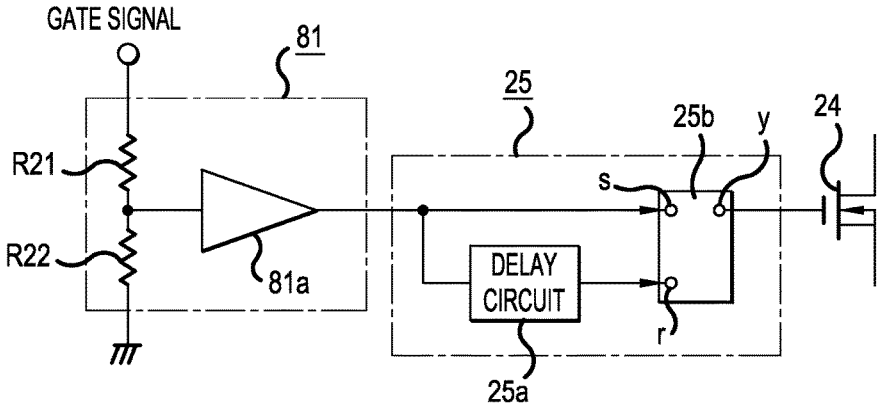
FIG. 16 is a circuit diagram of specific construction of the gate voltage drop detecting circuit and the multiple ignition circuit in the third embodiment.

The gate voltage drop detecting circuit 81 comprises, as shown in FIG. 16, shunt resistors R21 and R22 that receive a gate signal, and the voltage at the node between the shunt resistor R21 and the shunt resistor 22 is delivered to a decision circuit 81*a*. The decision circuit 81*a* determines whether the voltage has dropped below the predetermined voltage value during the process of transition from a state of the gate signal for multiple ignition at a high level to a low level. 1*a* usually delivers a low level determining signal to the flip-flop circuit 25*b* and the delay circuit 25*a* of the multiple ignition circuit 25. When the voltage at the process of transition of the gate signal for the multiple ignition from a high level to a low level drops below the predetermined voltage, the decision circuit 81*a* delivers a determining signal at a high level to the flip-flop circuit 25*b* and the delay circuit 25*a* of the multiple ignition circuit 25.

In the third embodiment, when engine control unit 30 is delivering the gate signal same as the one in the case of the first and second embodiments, at the time of inversion of the gate signal from a high level to a low level, a determining signal at a high level is given from the decision circuit 81*a* of the gate voltage drop detecting circuit 81 to the flip-flop circuit 25*b* and the delay circuit 25*a* of the multiple ignition circuit 25. As a result, the first active element 24 becomes an ON state during the delay time of the delay circuit 25*a*, making the voltage-controlled type semiconductor element 21 in an OFF state. Thus, the collector voltage Vc to rise up to the clamp voltage and generates spark discharge in the ignition device 12.

On the other hand, when the engine control unit 30 detects a low temperature state or a decreased state of the battery voltage, the gate signal for multiple ignition is delivered as the time chart (a) in FIG. 15.

When this gate signal for multiple ignition is delivered to the gate terminal tg of the ignition control section 20, at the time t21 when the first rectangular wave W1 turns to a high level, the voltage-controlled type semiconductor element 21 turns ON. As a result, the collector current Ic gradually increases as shown by the time chart (b) in FIG. 15 and accordingly the collector voltage Vc drops to a voltage value near the ground level. During the first rectangular wave W1 is kept at a high level, the decision circuit 81*a* of the gate voltage drop detecting circuit 81 is delivering a determining signal at a low level to the flip-flop circuit 25*b* and the delay circuit 25*a* of the multiple ignition circuit 25. Consequently, the flip-flop circuit 25*b* remains at a reset state and the gate signal delivered from the positive output terminal y also remains at a low level. Thus, the first active element 24 is held in an OFF state.

Then at the time t22, the collector current Ic reaches the current limiting value, and then at the time t23 when the first rectangular wave W1 changes from a high level to a low level and the gate voltage at this moment drops below the predetermined voltage, the decision circuit 81*a* of the gate voltage drop detecting circuit 81 delivers a determining signal at a high level to the flip-flop circuit 25*b* and the delay circuit 25*a* of the multiple ignition circuit 25. As a result, as in the first and second embodiments, the flip-flop circuit 25*b* is set and delivers a gate signal at a high level from the positive output terminal y to the gate of the first active element 24. Consequently, the first active element 24 turns ON and the charges accumulated on the gate of the voltage-controlled type semiconductor element 21 are discharged to the ground without passing through any resistance element and through the path with the minimum wiring resistance including the first active element 24. Accordingly, the voltage-controlled type semiconductor element 21 turns OFF and as in the first embodiment illustrated in FIG. 6, the collector current Ic abruptly drops and the collector voltage sharply rises up to the clamp voltage. Thus, the ignition device 12 generates spark discharge and drives the internal combustion engine.

Then at the time t24 when a delayed determining signal is delivered from the delay circuit 25*a*, the flip-flop circuit 25*b* is reset and the first active element 24 returns to an OFF state. At the same time, the second rectangular wave W2 of the multiple ignition gate signal changes to a high level as shown by the time chart (a) in FIG. 15 to turn ON the voltage-controlled type semiconductor element 21. As a result, the collector current Ic increases and the collector voltage Vc drops abruptly down to a voltage near the ground potential level. Then after the collector current Ic has reached the current limiting value, at the time t25, the second rectangular wave W2 changes from a high level to a low level.

As a result, similarly to the event at the time t23, when the gate voltage drops below the predetermined voltage, a determining signal at a high level is delivered from the decision circuit 81*a* to the flip-flop circuit 25*b* and the delay circuit 25*a* of the multiple ignition circuit 25. As a result, the gate signal delivered from the flip-flop circuit 25*b* changes to a high level to turn ON the first active element 24. The charges accumulated on the gate of the voltage-controlled type semiconductor element 21 are discharged abruptly to the ground through the first active element 24. Thus, the voltage-controlled type semiconductor element 21 turns OFF and the ignition device 12 generates spark ignition.

Similarly at the time t26, when the third rectangular wave W3 turns to a high level, then following the operation as described above, at the moment the third rectangular wave W3 changes from a high level to a low level, the first active element 24 turns ON to turn OFF the voltage-controlled type semiconductor element 21 abruptly. Thus, the collector voltage rises to the clamp voltage and the ignition device 12 generates spark discharge.

In this third embodiment, the multiple ignition operation is performed by the gate signal for multiple ignition from the engine control unit 30. The multiple ignition circuit 25 controls the first active element 24 to turn ON when the gate voltage changes from a high level to a low level. The charges accumulated on the gate of the voltage-controlled type semiconductor element 21 are discharged to the ground through a minimum wiring resistance without passing through any resistance element. Thus, the turning OFF operation of the voltage-controlled type semiconductor element 21 is surely performed with immediate response. Therefore, the effects in the first and second embodiments are obtained also in this third embodiment.

In the above description about the third embodiment, the gate signal for multiple ignition is delivered from the engine control unit 30 to the ignition control section 20. However, it is also possible to supply a gate signal similar to the one in the first and second embodiments and to provide the ignition control section 20 with the multiple ignition circuit 25 and the timer circuit 26, or with the multiple ignition circuit 25, the timer circuit 26, and the temperature detection or voltage detection circuit. In this case, the same operation is conducted as in the first and second embodiments except that the multiple ignition circuit 25 and the timer circuit 26 are driven by the internal power supply voltage of the internal power supply circuit 80, and the same effects as in the first and second embodiments are obtained.

Next, a fourth embodiment of the present invention will be described with reference to FIG. 17. In this fourth embodiment, when the normal ignition operation is changed to the multiple ignition operation in the second embodiment, the clamp voltage is simultaneously enhanced.

Figure 17:
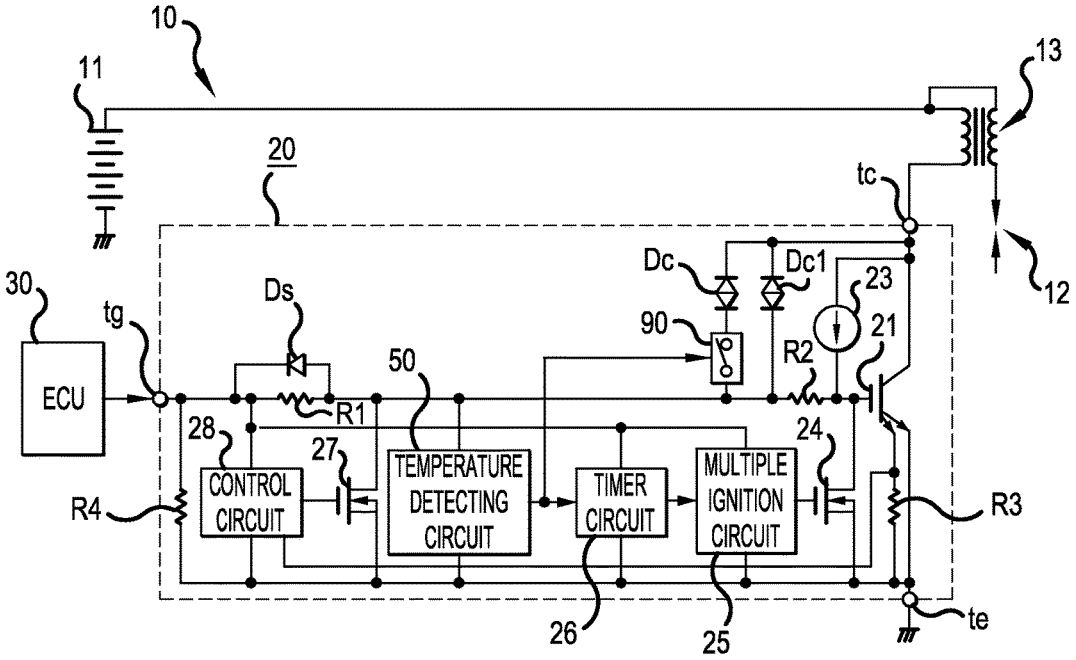
FIG. 17 is a circuit diagram of an ignition control device according to a fourth embodiment of the present invention.

As shown in FIG. 17 in the fourth embodiment, a high withstand voltage switching element 90 is provided in series to the clamp diode Dc to the construction of the second embodiment shown in FIG. 8. In parallel to the series circuit of the clamp diode Dc and the switching element 90, a clamp diode Dc1 is connected with a higher clamp voltage for example 500 V than the clamp voltage of the clamp diode Dc for example 400 V. A temperature detection signal is delivered by the temperature detecting circuit 50 to the switching element 90 through an inverter. The switching element 90 is controlled to an OFF state when the temperature detection signal is at a high level and controlled to an ON state when the temperature detection signal is at a low level.

In this fourth embodiment, when the temperature of the voltage-controlled type semiconductor element 21 is higher than the predetermined temperature, a temperature detection signal at a low level is delivered from the determination circuit 62 of the temperature detecting circuit 50. Accordingly, the switching element 90 turns ON and the clamp diodes Dc and Dc1 are connected in parallel between the collector and the gate of the voltage-controlled type semiconductor element 21.

When the voltage-controlled type semiconductor element 21 is turned OFF after an ON state in this condition, the collector voltage Vc of the voltage-controlled type semiconductor element 21 rises to a clamp voltage that is the lower voltage of the clamp voltages of the two diodes Dc and Dc1. Thus, the effect same as the one in the second embodiment is achieved.

On the other hand, when the temperature of the voltage-controlled type semiconductor element 21 decreases below the predetermined temperature, a temperature detection signal at a high level is delivered from the determination circuit 62 of the temperature detecting circuit 50. As a result, the multiple ignition circuit 25 and the timer circuit 26 become in an operating state to perform multiple ignition operation. Because a temperature detection signal at a high level is delivered from the decision circuit 62 to the switching element 90 though an inverter, the switching element 90 turns OFF and the clamp diode Dc1 with a higher clamp voltage is solely connected between the collector and the gate of the voltage-controlled type semiconductor element 21. Consequently, when the voltage-controlled type semiconductor element 21 turns OFF from an ON state, the collector voltage Vc is clamped at a higher clamp voltage, for example 500 V, than under the normal operation condition. Thus, the discharge voltage supplied to the ignition device 12 is higher than in the normal condition, ensuring the spark discharge.

In this fourth embodiment, in a condition of a low temperature of the voltage-controlled type semiconductor element 21, the clamp voltage of the collector voltage Vc of the voltage-controlled type semiconductor element 21 is enhanced than in the normal ignition operation as well as the multiple ignition operation with an increased number of spark discharges in the ignition device 12. Thus, the multiple ignition is performed without failure, avoiding any hindrance to driving of the internal combustion engine.

Although the multiple ignition operation in the first through fourth embodiments is conducted with two times more spark discharges in the ignition device 12 as compared to the normal condition, the number of additional spark discharge in the ignition device 12 can be set at other arbitral number.

Figure 18:
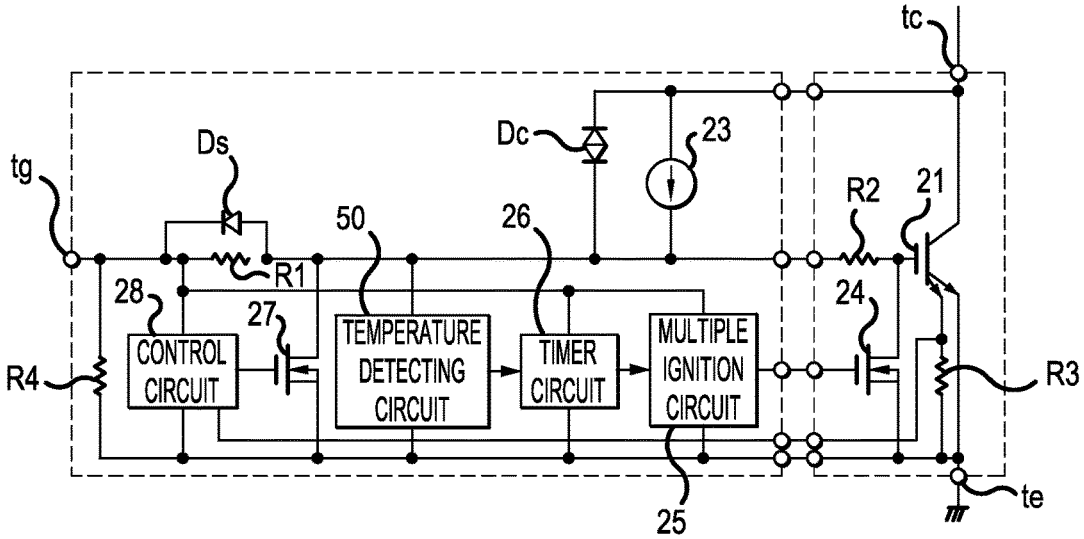
FIG. 18 is a circuit diagram of an ignition control device formed in two chips.

Although the ignition control section 20 is constructed in one chip igniter in the first through fourth embodiments described thus far, the ignition control section 20 can be composed, as illustrated in FIG. 18, of two chips: one chip including the voltage-controlled type semiconductor element 21 and the first active element 24, and the other chip including the multiple ignition circuit 25, the timer circuit 26, and other circuit elements, and the two chips are electrically connected.

What is claimed is:

1. An ignition control device for an internal combustion engine comprising:

an ignition coil supplying a discharge voltage to an ignition device of an ignition combustion engine;

a voltage-controlled type semiconductor element connected to a primary side of the ignition coil: and an ignition control section capable of repeating multiple times, in an ignition period, of operations of turning ON and turning OFF of the voltage-controlled type semiconductor element by giving a gate signal to a gate of the voltage-controlled type semiconductor element;

wherein the ignition control section includes an active element that discharges gate charges accumulated on the gate of the voltage-controlled type semiconductor element to the ground upon turning OFF operation of the voltage-controlled type semiconductor element, and that is connected between the gate and a resistor at a side of the gate inserted in a gate wiring connected to the gate of the voltage-controlled type semiconductor element.

2. The ignition control device for an internal combustion engine according to claim 1, wherein a resistance value of the gate wiring between the gate of the voltage-controlled type semiconductor element and a connection point of the active element is at most 300 mΩ.

3. The ignition control device for an internal combustion engine according to claim 1, wherein a resistance value of the gate wiring between the gate of the voltage-controlled type semiconductor element and a connection point of the active element is at most 100 mΩ.

4. The ignition control device for an internal combustion engine according to claim 1, wherein a resistance value of the gate wiring between the gate of the voltage-controlled type semiconductor element and a connection point of the active element is at most 50 mΩ.

5. The ignition control device for an internal combustion engine according to claim 1, wherein the ignition control section comprises a discharge control circuit that performs ON operation of the active element upon transition of the gate signal from an ON state to an OFF state.

6. The ignition control device for an internal combustion engine according to claim 1, wherein the ignition control section comprises:

a timer circuit that delivers timer signal s to repeatedly turn ON plural times the active element after an ON state of the gate signal and before an OFF state of the gate signal; and a discharge control circuit that performs ON operation of the active element according to the timer signal of the timer circuit.

7. The ignition control device for an internal combustion engine according to claim 1, wherein the ignition control section comprises a temperature detection circuit and has a construction to make the voltage-controlled type semiconductor element perform several times of turning ON operations and turning OFF operations when a temperature detected by the temperature detecting circuit is lower than a predetermined temperature.

8. The ignition control device for an internal combustion engine according to claim 1, wherein the ignition control section comprises a voltage detection circuit that detects a power supply voltage of a DC power supply for supplying power to the ignition coil and has a construction to make the voltage-controlled type semiconductor element perform several times of turning ON operations and turning OFF operations when a voltage detected by the voltage detecting circuit is lower than a predetermined voltage.

9. The ignition control device for an internal combustion engine according to claim 1, wherein the ignition control section is formed in a chip in which the voltage-controlled type semiconductor element is formed.

10. The ignition control device for an internal combustion engine according to claim 1, wherein the ignition control section is formed in a chip other than a chip in which the voltage-controlled type semiconductor element is formed.

11. The ignition control device for an internal combustion engine according to claim 1, wherein the ignition control section operates with a power supply of the gate signal supplied by an engine control unit.

12. The ignition control device for an internal combustion engine according to claim 1, wherein the ignition control section comprises an internal power supply circuit that is supplied with a power supply voltage of a DC power supply for supplying power to the ignition coil and delivers an internal operating power.

13. The ignition control device for an internal combustion engine according to claim 1, wherein the ignition control section comprises a clamp diode and a high withstand voltage constant current circuit connected in parallel between a high potential side terminal and a gate terminal of the voltage-controlled type semiconductor element.

14. The ignition control device for an internal combustion engine according to claim 13, wherein the high withstand voltage constant current circuit is composed of an insulated gate bipolar transistor of a depletion type.

15. The ignition control device for an internal combustion engine according to claim 1, wherein the voltage-controlled type semiconductor element is composed of either one of an insulated gate bipolar transistor and a MOS field effect transistor.

* * * * *